US005175905A

United States Patent [19]

Gutschmit

[11] Patent Number: 5,175,905

[45] Date of Patent: Jan. 5, 1993

[54] DEBRIS CLEANING APPARATUS FOR CIRCULAR KNITTING MACHINES

[75] Inventor: Alan Gutschmit, Troy, N.C.

[73] Assignee: Alandale Industries, Inc., Troy, N.C.

[21] Appl. No.: 732,784

[22] Filed: Jul. 19, 1991

[51] Int. Cl.[5] ..... D04B 35/32

[52] U.S. Cl. ..... 15/312.1; 15/301; 15/316.1; 66/168

[58] Field of Search ..... 15/301, 312.1, 316.1; 66/168

[56] References Cited

U.S. PATENT DOCUMENTS

| | | | |
|---|---|---|---|
| 1,332,875 | 3/1920 | Ainsworth | 15/312.1 X |
| 1,939,481 | 12/1933 | Albers | 15/312.1 X |
| 1,987,582 | 1/1935 | Terrell . | |
| 2,976,557 | 3/1961 | King . | |
| 3,072,321 | 1/1963 | King . | |
| 3,545,029 | 12/1970 | Walmsley et al. . | |
| 3,571,840 | 3/1971 | Gleaton et al. . | |
| 3,783,648 | 1/1974 | Heinrichs . | |
| 4,540,138 | 9/1985 | Gutschmit . | |
| 4,691,536 | 9/1987 | Yorisue et al. . | |
| 4,915,835 | 4/1990 | Barzuza et al. . | |
| 4,948,067 | 8/1990 | Gutschmit . | |

FOREIGN PATENT DOCUMENTS 2842819 10/1980 Fed. Rep. of Germany .

OTHER PUBLICATIONS

Brochure of Texma Luigs GmbH; Hamburg, Germany; date unknown, (Handwritten date Sep. 1980 unverified).

Brief news article entitled "Paepke Lint Blower", *Knitting International*, Mar. 1984.

*Primary Examiner*—Chris K. Moore

*Attorney, Agent, or Firm*—Shefte, Pinckney & Sawyer

[57] ABSTRACT

A debris cleaning apparatus (10) for a circular knitting machine (12) includes a horizontal radial support arm (24) rotatably mounted coaxially to the machine frame (14) with a rotary paddle-type fan (26) pivotably mounted to the outward end of the support arm for oscillating movement within a vertical plane. A drive motor (38) rotates the support arm and fan as a unit while simultaneously imparting oscillating movement to the fan (26) through an eccentrically driven actuating arm (56). In this manner, a moving airstream generated by the fan is directed through the range of its oscillating movement over the knitting and yarn feeding instrumentalities of the machine about its full circumferential extent to blow lint from the surfaces.

11 Claims, 2 Drawing Sheets

DEBRIS CLEANING APPARATUS FOR CIRCULAR KNITTING MACHINES

BACKGROUND OF THE INVENTION

The present invention relates to apparatus for controlling lint, dust and other debris in textile plants and, more specifically, to an apparatus particularly adapted to be mounted on a circular knitting machine to remove such debris therefrom and to limit debris accumulation thereon.

At substantially all stages of the processing of textile fibers, particularly cotton, from the initial fiber cleaning and preparation stage through yarn spinning and fabric production, the necessary handling of the textile fibers and yarns inherently liberates minute pieces of fiber, commonly referred to as lint, as well as other particulate dust and debris which tend to become readily airborne within the work area of the textile processing plant and ultimately to settle and accumulate on machinery and other exposed surfaces within the plant interior. Lint, dust and other debris pose a variety of problems to the textile manufacturer. For example, in fabric production operations, airborne lint and dust which settle on the processing machinery or on the yarn being utilized may cause defects in the fabric being produced and may adversely affect the proper operation of the fabric-producing machinery, in turn affecting operating efficiency and revenues.

One type of textile fabric-producing machine which is particularly subject to these problems is a circular knitting machine. In particular, large-diameter circular knitting machines may have a cylinder diameter of several feet with hundreds or even thousands of needles slidably supported in axial needle slots in the cylinder periphery and a corresponding number of needles, sinkers or other knitting instruments in radial slots in a cooperating dial concentric with the cylinder. Such knitting machines typically also have numerous yarn feeding stations spaced about the circumference of the cylinder each supplied from overhead with one or more individual yarns traveling through a series of stop motions and/or yarn storage feeding devices. In such circular knitting machines, it is important to prevent or at least minimize lint and other debris accumulation on the individual yarns as they are fed, on the instruments through which they are fed (e.g., stop motions, storage feeders, etc.) and on the knitting needles and the associated operative components and surfaces of the needle cylinder and dial of the knitting machine in order to promote cleanliness of the yarns and proper operation of the knitting instrumentalities of the machine.

SUMMARY OF THE INVENTION

It is accordingly an object of the present invention to provide a cleaning apparatus particularly adapted for mounting on a circular knitting machine of the aforedescribed type for removing accumulated debris therefrom and for limiting further debris accumulation thereon, especially at the critical upper areas of the machine wherein yarn feeding and knitting takes place.

Briefly summarized, the cleaning apparatus of the present invention accomplishes this objective by providing a blower, preferably in the form of a motor-driver rotary paddle-type fan, mounted at the extending end of a support arm extending radially outwardly from an upstanding shaft mounted centrally above a circular knitting machine. The length of the support arm is selected to dispose the fan or other blower generally vertically above the outer periphery of the knitting machine cylinder and dial and above the immediately associated yarn feeding instrumentalities such as storage feeders and/or stop motions. A drive motor arrangement or other suitable means is provided for rotating the support arm about the shaft and for simultaneously oscillating the fan or blower through a predetermined range of motion within a generally vertical plane of movement. In this manner, the blower directs a moving airstream over the full circumferential extent of the knitting machine within a predetermined vertical area determined by the extent of blower oscillation to blow accumulated debris from, and limit debris accumulation on, any operative surfaces within the affected area.

In the preferred embodiment, the fan or other blower is pivotably mounted to a clevis portion at the outward extending end of the support arm for pivoting movement about a generally horizontal axis. The radial support arm is affixed to a housing which is mounted rotationally to the upright shaft by an electrical slip ring. An electric drive motor is mounted in the housing and is supplied with electrical operating power through the slip ring. A first rotational driving connection is provided between the motor and the shaft for rotating the housing, support arm and blower as a unit about the upright shaft. The motor is also drivingly connected with an eccentric drive member or other suitable reciprocal drive arrangement, with an actuating arm extending therefrom to the blower for longitudinal reciprocation to impart oscillating movement to the blower. Preferably, both the support arm and the actuating arm are selectively extensible for adjusting their respective effective lengths. Suitable stops are provided on the clevis portion to define a maximum range of oscillating movement of the fan or other blower.

DESCRIPTION OF THE PREFERRED EMBODIMENT

Figure 1:
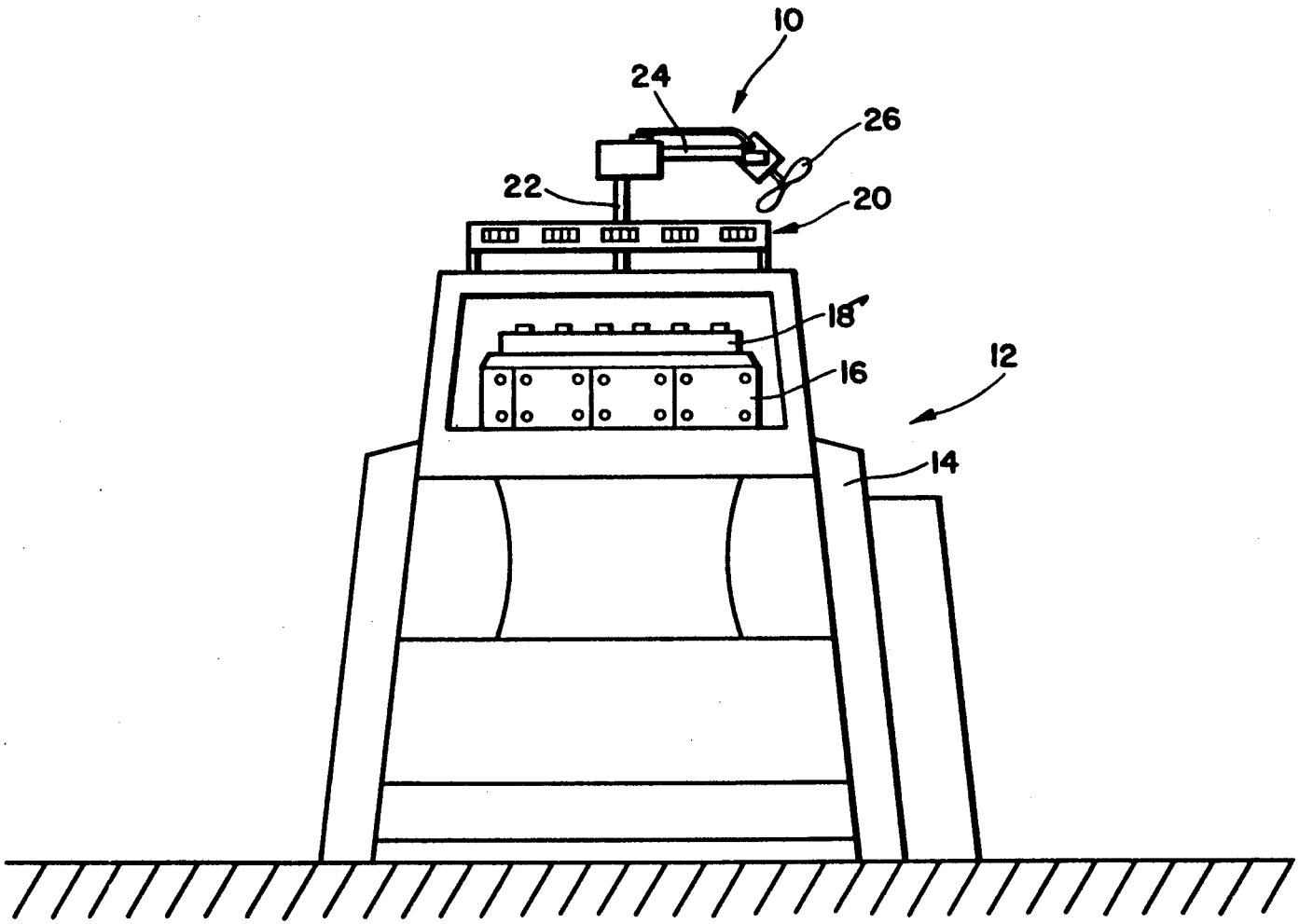
FIG. 1 is a schematic side elevational view of a representative conventional circular knitting machine having the debris cleaning apparatus of the present invention installed thereon.

Referring now to the accompanying drawings and Initially to FIG. 1, the debris cleaning apparatus of the present invention is shown generally at 10 in its preferred installation mounted vertically above and concentric with a circular textile knitting machine, representatively indicated at 12. As will be understood, the debris cleaning apparatus 10 may be installed on virtually any conventional circular knitting machine, the machine 12 being intended to be characteristically representative of any such machine. Specifically, the circular knitting machine 12 basically comprises a frame 14 supporting an upright rotary needle cylinder 16 formed about the entirety of its periphery with plural axial needle slots in the upper ends of which knitting needles are slidably supported. A circular dial plate 18 is supported horizontally at the upper end of the needle cylinder 16 for integral rotation therewith, the dial 18 being formed with a corresponding number of radial slots in which another set of knitting instruments (needles, sinkers, or the like) are slidably supported for knitting manipulation in conjunction with the cylinder needles. Multiple knitting stations spaced circumferentially about the cylinder 16 and dial 18 are supplied with individual yarns from an associated yarn package creel (not shown) downwardly through an elevated series of yarn guiding elements usually including stop motions and/or storage feeding devices, generally represented at 20, typically disposed generally directly above the knitting stations.

Figure 2:
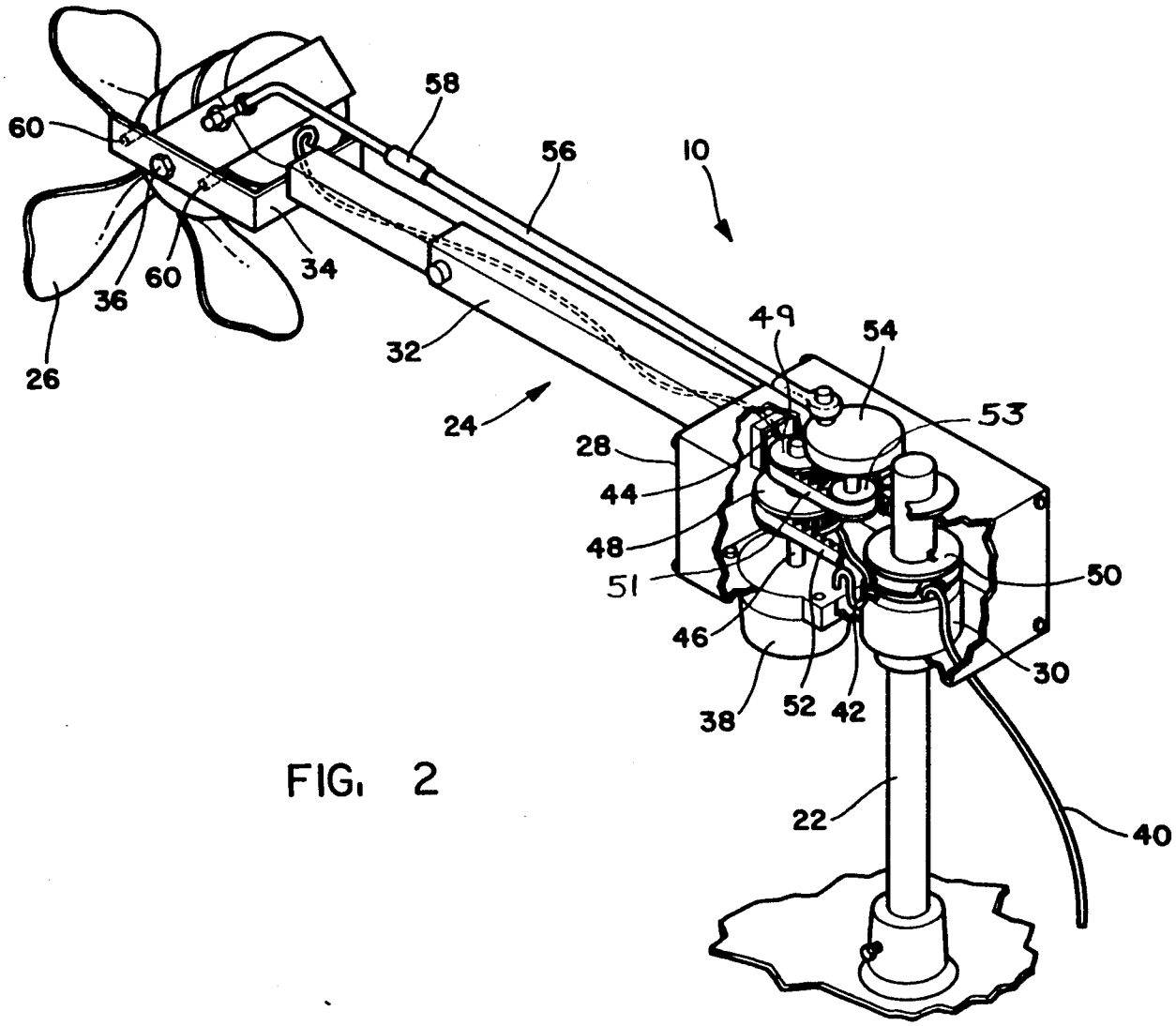
FIG. 2 is an enlarged top perspective view of the debris cleaning apparatus of FIG. 1, partially broken away to illustrate internal components thereof.

The particular construction of the debris cleaning apparatus 10 is best seen in FIG. 2. An upright shaft 22 is affixed centrally to the upper end of the knitting machine frame 14 to extend in upstanding relation therefrom substantially coaxially therewith. A support arm assembly 24 is rotatably supported at one end on the shaft 22 and extends horizontally outwardly therefrom in radial relation to the circular knitting machine 12. A blower 26, preferably in the form of an electrically-operated rotary paddle-type fan, is mounted at the outward extending end of the support arm assembly 24.

The support arm assembly 24 includes a box-shaped housing 28 at its radially inward end, which is supported on the upright shaft 22 by an electric slip ring assembly 30. A telescoping tubular arm 32 is rigidly affixed to and extends outwardly from one side of the housing 28. A clevis member 34 is affixed to the outwardly extending end of the telescoping arm 32 and pivotably supports the housing of the fan 26 for pivoting movement within a generally vertical plane of movement about a substantially horizontal pivot axis 36.

Within the housing 28, an electric drive motor 38 is mounted in upright disposition alongside the slip ring assembly 30. Electrical operating power is delivered through a suitable lead 40 to the slip ring assembly 30 which, in turn, transmits electrical power to the motor 38 through an output lead 42 and to the motor of the fan 26 through a separate output lead 44 extending through the telescoping arm assembly 32.

The drive motor 38 has an upwardly extending drive shaft 46 carrying a first drive cog 48 connected with a similar cog 50 affixed to the upright shaft 22 within the housing 28 by means of a timing belt 52 trained about the cogs 48, 50. In this manner, the motor 38 imparts rotational movement to the support arm assembly 24 and the fan 26 as a unit about the upright shaft 22.

A second drie cog 49 on the motor drive shaft 46 is similarly connected via a timing belt 51 in driving relation with a cog 53. A drive disk 54, disposed at the upper exterior side of the housing 28, is affixed coaxially with the cog 53 to be drivenly rotated therewith by the motor 38. An elongate actuating arm 56 is affixed at one end eccentrically to the drive disk 54 and at the other end to the motor housing of the fan 26. In this manner, rotational movement imparted to the drive disk 54 by the motor 38 is translated into reciprocating motion of the actuating arm 56 to pivotably oscillate the fan 26 on the clevis member 34 within a range of vertical motion determined by the eccentric mounting of the actuating arm 56 to the disk 54.

The actuating arm 56 is telescopically extensible by means of a frictional slide connection 58. Stop members 60 extend inwardly from the clevis member 34 to define the maximum permissible range of vertical oscillating movement of the fan 26.

As will thus be understood, in normal operation, the debris cleaning apparatus 10 is initially set up by extending the telescoping support arm 32 to an effective length sufficient to dispose the fan 26 generally directly above the outer periphery of the cylinder and dial 16, 18 and thereby either laterally adjacent or generally above the yarn feeding components associated with the knitting stations, such as the storage feeders and/or stop motions 20 and other yarn guiding elements. The frictional slide connection 58 of the telescopical actuating arm 56 enables it to automatically extend, or withdraw, in correspondence to the support arm 32. The stop members 60 on the clevis 34 ensure that the available range of vertical oscillating motion of the fan 26 will be substantially the same at any effective length of the support arm assembly 24.

Upon energization of the slip ring assembly 34, electrical power is supplied to the drive motor 38 and simultaneously to the motor of the fan 26, causing the support arm assembly 24 and the fan 26 to rotate as a unit about the upright shaft 22 and the fan 26 simultaneously to oscillate within a vertical plane of movement. Preferably, the eccentric mounting of the actuating arm to the drive disk 54 is selected to impart a range of oscillating motion to the fan 26 of approximately 135° about the pivot axis 36.

With the paddle wheel of the fan 26 being continuously driven as the support arm assembly 24 rotates and the fan 26 oscillates, the moving airstream generated by the fan 26 is directed downwardly and outwardly within the aforesaid range of oscillating motion over the full circumferential extent of the circular knitting machine 12, thereby blowing the airstream over the slots, the needles and other knitting instruments within the cylinder and dial 16, 18, and over the storage feeders and/or stop motions 20 and other yarn guiding elements to blow accumulated lint and debris off these machine components and to limit further debris accumulation thereon. By utilizing only a single fan to cover a relatively wide area, energy usage as well as maintenance of the cleaning apparatus is minimized.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for removing debris from a circular knitting machine comprising:

an upstanding shaft mounted centrally above said knitting machine, a support arm extending radially outwardly from said shaft, a blower mounted at the extending end of said support arm, means for rotating said support arm about said shaft, said rotating means being disposed at said shaft in drive connection therewith, and means for oscillating said blower through a predetermined range of motion within a generally vertical plane of movement simultaneously with said rotating means for directing a moving airstream over a predetermined area of said knitting machine to blow debris therefrom and limit debris accumulation thereon.

2. Apparatus for removing debris from a circular knitting machine according to claim 1 and characterized further in that said support arm is selectively extensible for adjusting the effective length of said support arm.

3. Apparatus for removing debris from a circular knitting machine according to claim 1 and characterized further in that said blower comprises a rotary paddle-type fan.

4. Apparatus for removing debris from a circular knitting machine according to claim 1 and characterized further in that said support arm includes a clevis portion at its extending end, said blower being pivotably mounted to said clevis portion about a generally horizontal axis.

5. Apparatus for removing debris from a circular knitting machine according to claim 1 and characterized further in that said blower oscillating means comprises means mounting said blower movably at the extending end of said support arm, an actuating arm attached to said blower, and means for reciprocating said actuating arm longitudinally to impart oscillating movement to said blower.

6. Apparatus for removing debris from a circular knitting machine according to claim 5 and characterized further in that said reciprocating means comprises an eccentric drive means attached to said actuating arm.

7. Apparatus for removing debris from a circular knitting machine according to claim 5 and characterized further in that said support arm is selectively extensible for adjusting the effective length of said support arm and said actuating arm is selectively extensible for adjusting the effective length of said support arm.

8. Apparatus for removing debris from a circular knitting machine according to claim 5 and characterized further by a housing mounted rotationally to said shaft, said support arm being affixed to said housing, said rotating means and said oscillating means comprising a common drive motor supported in said housing, a first rotational driving connection between said motor and said shaft, and a second reciprocal driving connection between said motor and said actuating arm.

9. Apparatus for removing debris from a circular knitting machine according to claim 8 and characterized further by a slip ring mounting said housing to said shaft for transmitting electrical operating power to said drive motor.

10. Apparatus for removing debris from a circular knitting machine according to claim 8 and characterized further in that said rotating means and said oscillating means comprise a common drive means disposed at said shaft, a first rotational driving connection between said drive means and said shaft, and a second reciprocal driving connection between said motor and said blower.

11. Apparatus for removing debris from a circular knitting machine according to claim 1 and characterized further in that said blower oscillating means includes stop means for defining a maximum range of oscillating movement of said blower.

* * * * *